US005778963A

United States Patent [19]

Parille et al.

[11] Patent Number: 5,778,963

[45] Date of Patent: Jul. 14, 1998

[54] METHOD OF CORE LEACH

[75] Inventors: Donald R. Parille; Earle Arthur Ault, both of South Windsor, Conn.

[73] Assignee: United Technologies Corporation, Hartford, Conn.

[21] Appl. No.: 706,392

[22] Filed: Aug. 30, 1996

[51] Int. Cl.[6] ..... B22D 29/00; B08B 3/08; B08B 9/00

[52] U.S. Cl. ..... 164/132; 134/22.18; 134/24; 134/30

[58] Field of Search ..... 164/132, 131; 134/22.17, 22.18, 24, 30

[56] References Cited

U.S. PATENT DOCUMENTS

| | | | |
|---|---|---|---|
| 3,226,785 | 1/1966 | Moxlow et al. . | |
| 3,563,711 | 2/1971 | Hammond et al. | 23/312 |
| 3,694,264 | 9/1972 | Weinland et al. . | |
| 4,073,662 | 2/1978 | Borom | 134/2 |
| 4,439,241 | 3/1984 | Ault et al. | 134/22.17 |
| 4,490,180 | 12/1984 | Prikhodko et al. | 134/1 |
| 4,569,384 | 2/1986 | Mills | 164/131 |
| 5,273,104 | 12/1993 | Renaud et al. | 164/529 |
| 5,303,761 | 4/1994 | Flessner et al. | 164/15 |
| 5,575,858 | 11/1996 | Chen et al. | 134/22.19 X |
| 5,618,353 | 4/1997 | Irvine et al. | 134/22.17 |
| 5,685,917 | 11/1997 | Sangeeta | 164/132 X |

FOREIGN PATENT DOCUMENTS

| | | |
|---|---|---|
| 2511904 | 3/1983 | France . |
| 3537351 | 4/1987 | Germany . |
| 61-7058 | 1/1986 | Japan . |
| 63-50106 | 10/1988 | Japan . |
| 64-27767 | 1/1989 | Japan . |
| 2-121747 | 5/1990 | Japan . |
| 1312173 | 4/1973 | United Kingdom . |
| 1602027 | 11/1981 | United Kingdom . |

OTHER PUBLICATIONS

Abstract of British Patent Publication No. 1602027 published Nov. 4, 1981.

Abstract and Drawing of U.S.S.R. Inventor's Certificate 470365 published Jul. 22 1975.

Abstract of Japanese Patent Publication No. 64–27767 published Jan. 30, 1989.

Abstract of Japanese Patent Publication No. 2–121747 published May 9, 1990.

Abstract of Japanese Patent Publication No. 63–50106 published Oct. 6, 1988.

Abstract of French Patent Publication No. 2511904 published Mar. 4, 1982.

Abstract of Japanese Patent Publication No. 61–7058 published Jan. 13, 1986.

Abstract of German Patent Publication No. 3537351 published Apr. 23, 1987.

Translation of German Patent Publication No. 3537351 published Apr. 23, 1987.

*Primary Examiner*—J. Reed Batten, Jr.

*Attorney, Agent, or Firm*—Brooks Haidt Haffner & Delahunty

[57] ABSTRACT

A ceramic core is removed from an investment casting by directing a stream of high pressure alkali solution between about 5,000 psi (345 bar) and about 10,000 psi (690 bar) at the core to loosen and dissolve the core.

11 Claims, No Drawings

METHOD OF CORE LEACH

BACKGROUND OF THE INVENTION

1. Technical Field

The present invention relates generally to a method of removing cores from investment castings and particularly to a method of removing ceramic cores from gas turbine engine component castings.

2. Background Information

Investment casting processes are frequently employed in the production of gas turbine engine components, such as turbine blades and vanes. Typically, in investment casting processing, a wax pattern is produced by injecting wax into a die cavity. If, however, the component is to contain internal passages, then a preformed core, typically ceramic, is inserted into the die cavity prior to injecting the wax around the core. This is frequently the case because modern gas turbine engine components operate at increasingly higher gas temperatures for improved performance and efficiency, such as temperatures near the melting point of the alloys from which the components are built. As a result, advanced cooling schemes, such as intricate cooling passages for lower temperature air, are necessary to cool the surface of the components exposed to such harsh operating conditions. These intricate cooling passages may be formed in the component by incorporating a core of particular configuration in the wax pattern.

The wax pattern is then removed from the die cavity and a rigid ceramic shell mold is formed around the wax pattern. Upon drying, the mold is dewaxed, typically in an oven, and fired to increase its strength for storage and handling. A cavity defined by the core and mold walls thereby results. Molten metal is then poured into the cavity and solidifies into the desired component shape. Finishing steps are then employed, such as initial removal of the ceramic shell.

A problem encountered in investment casting processing, however, is complete and efficient removal of the ceramic core after the ceramic shell is removed. Removal is particularly difficult because most cores for use in modern gas turbine engines are of intricate design and have an extremely small cross-section. Due to the complexity and size of these cores, it is difficult to rapidly and thoroughly remove the ceramic material, particularly if the core is of a serpentine design. Complete removal is essential for successful engine operation. Specifically, if any ceramic residue remains inside the casting, the residue may interfere with cooling of the component during service and possibly cause premature failure.

Conventional core removal techniques include immersing the component in an alkali leaching solution, such as NaOH or KOH solution, in an open pot or under pressure in an autoclave. Agitation of the solution and/or casting may be employed to expedite the leaching process. Although immersion/agitation techniques are useful, complete removal of the ceramic material is difficult, if not impossible, and these techniques require numerous, lengthy cycles to complete. The leaching process for cores of complex design may even take several days to complete. Often, resultant cooling passages show minor residual core material even after numerous cycles. Thus, sophisticated inspection techniques must often be employed.

Other attempts at removing cores from investment castings include that which is disclosed in German Patent No. 3537351 entitled, Method and Device for Dissolving a Core from a Casting, the contents of which are herein incorporated by reference. This patent discloses a method of spraying a liquid stream through nozzles directed at the ceramic core under normal external pressure or under slightly increased pressure (up to 6 bar in front of nozzles).

The above art notwithstanding, scientists and engineers working under the direction of applicants' assignee are still seeking to develop improved methods of removing ceramic cores from investment castings. Accordingly, there exists a need for a method that can rapidly and completely remove intricate shaped ceramic cores from investment castings.

DISCLOSURE OF THE INVENTION

According to the present invention, a method of rapidly and completely removing ceramic cores from investment castings, particularly gas turbine engine blades and vanes having complex core designs, is provided. An aspect of the invention includes directing a stream of high pressure alkali solution between about 5,000 psi (345 bar) and about 10,000 psi (690 bar) at the core to loosen and dissolve the core.

Another aspect of the invention includes positioning the stream of high pressure alkali solution below the core and pulsing the high pressure stream upward toward the core to loosen and dissolve the ceramic core. Preferably, between about 1 seconds and about 10 seconds elapse between each pulse.

Yet another aspect of the invention includes a method of refurbishing an investment casting. The method comprises providing an investment casting having an internal cavity with debris material therein; and directing a stream of high pressure solution between about 5,000 psi (345 bar) and about 10,000 psi (690 bar) at the debris material to loosen and remove the material.

An advantage of the present invention includes the ability to rapidly and completely remove ceramic cores of intricate design and small cross-sectional area from investment castings. High pressure impingement of alkali solution onto the core ensures effective dissolution and removal of the ceramic material, particularly ceramic residue. The present invention significantly reduces cost and cycle time, and reliably removes the core so that post leach inspection is not necessary.

Another advantage is that the present invention may be employed in an open pot or in an autoclave. Most conventional leaching operations for complex cooling designs require leaching under pressure in an autoclave.

Yet another advantage is that the present invention may be employed to remove debris from within an airfoil and thereby clean the airfoil.

These and other features and advantages of the present invention will become more apparent in light of the detailed description of the best mode for carrying out the invention.

BEST MODE FOR CARRYING OUT THE INVENTION

A method of rapidly and completely removing a ceramic core from an investment casting is disclosed. An investment casting suitable for the present invention includes a core disposed within the investment casting interior such that one end of the core is exposed to the atmosphere, for example, via the root end of the investment casting or other cooling air entrance location.

Fabrication of the investment casting is conventional and includes techniques discussed above. The investment casting is preferably a nickel, iron or cobalt based superalloy, but other metallic materials may be employed. The investment casting may be fixtured in a stationary position or one that permits motion of the investment casting, for example, in the case of rotation of numerous castings.

Fabrication of the core is also conventional and typically includes a mixture of ceramic particles molded into the desired core shape with use of a volatile binder. Firing of the molded mixture is then employed to drive off the binder and sinter the ceramic particles together to form the finished ceramic core. Conventional ceramic particles employed in investment casting processing include zirconia, silica and alumina. Cores particularly suited for the present invention include those of small cross-section and intricate design.

The method of the present invention includes directing a stream of high pressure alkali solution at the core surface to loosen and dissolve the ceramic core material. The alkali solution may include, but is not limited to, a solution of an alkali metal hydroxide, such as NaOH or KOH, with a concentration, by weight percent, between about 20% and about 50%. Although an alkali metal hydroxide solution is preferred, one of ordinary skill in the art would recognize that other suitable liquids may be employed to dissolve and/or react with the ceramic material to expedite core removal. The liquid, however, must not detrimentally interfere with the properties of the investment casting material. A high temperature liquid, such as between about 200° F. (93° C.) and about 600° F. (316° C.) may be employed to facilitate core removal, although a high temperature liquid is not required.

The pressure of the stream of solution may be between about 5,000 psi (345 bar) and about 10,000 psi (690 bar). Such high pressure is necessary to adequately loosen and dissolve the ceramic material. The pressure may be continuous or varied between about 5,000 psi (345 bar) and about 10,000 psi (690 bar) during the removal process.

Preferably, the solution flows through a jet or pressure port having a small diameter nozzle through which the solution exits at the above mentioned pressure. Preferably, the inner diameter of the nozzle is between about 20 mils (0.508 mm) and about 70 mils (1.78 mm). Such small diameter nozzles may be located at or near the core surface at the root end of the investment casting or preferably within the core passage or cavity upon removal of a portion of the ceramic material. This close positioning of the nozzle to the core facilitates core removal. Solution feed to the jet or pressure port is conventional and includes incorporation of a vat of desired solution and controllable pumping mechanism.

The stream of solution exiting the nozzle may be continuous or pulsed. The flow rate of the solution may be between about 0.3 gallons/minute and about 10 gallons/minutes. However, one of ordinary skill in the art will recognize that the flow rate of the solution may depend on variables, including but not limited to, nozzle diameter and core size.

Preferably, the nozzle is positioned beneath the root end of the investment casting and the high pressure stream is pulsed upward toward the core with momentary delays, such as between about 1 second and about 10 seconds, between the pulses. This mode allows initial loosened ceramic material to exit the investment casting during the momentary delays by gravity. This mode is particularly advantageous in that it allows pulses of fresh solution to impinge against the core. This is desirable because the core removal process is influenced primarily by the amount of soluble constituent in the core material. The duration of core removal processing is proportional to the rate at which reaction products produced during the removal process are able to move out of the casting interior. This processing time is reduced by pulsing fresh solution into the interior of the casting.

This pulsating mode of operation is particularly advantageous for serpentine or other complex core designs because it allows the high pressure flow of solution to cause mechanical damage to the core in addition to the chemical removal of ceramic material.

As the leaching process progresses and ceramic material is removed from the core by gravity between the pulses, the high pressure solution will eventually follow the path of normal air flow during engine operation, and exit at the same location as the cooling airflow would during engine operation. The exit locations depend on the airfoil design and may include exits at the trailing edge, leading edge, root, tip or any combination thereof. Preferably, the leaching process is performed in an enclosed system.

As an additional feature of the above described pulsating mode embodiment, a continuous stream of solution, such at about 100 psi (7 bar), may be simultaneously employed to further aid removal of the ceramic material.

The present invention also includes additional steps which may be employed, if necessary, to ensure complete removal of ceramic residue. For example, steam or other similar high temperature vapors in a continuous or pulsating mode, as described above for the solution, may be directed at the resultant core cavity as a subsequent step to ensure removal of ceramic residue. Alternatively, changing from leaching solution to a stream of water, such as hot water or steam, to break up and remove core particles may also be beneficial.

In yet another embodiment of the present invention, a negative pressure, such as a vacuum or partial vacuum, may be employed. Preferably, the vacuum or partial vacuum is employed after the leaching process to ensure complete removal of ceramic residue. However, a hard vacuum should not be employed. A vacuum slightly below atmospheric conditions, such as about 150 microns, is sufficient.

The present invention may be used with traditional immersion/agitation removal techniques as a supplement to traditional core removal processing. However, this embodiment is not preferred because of the additional processing time and because employment of the present invention alone effectively removes the ceramic material.

A significant advantage of the present invention is elimination of the need for subsequent costly post inspection techniques, such as N-ray inspection. However, if desired, the investment casting may be inspected by conventional techniques, such as x-ray radiography, to ensure complete removal of the residue.

Another advantage of the present invention is the ability to determine when the process is complete by virtue of solution exiting the airfoil via the cooling airflow holes. For example, if the solution exit spray is even and present at the exit locations then the ceramic core has been completely removed. However, if some exit locations are partially blocked then the leaching process should continue. If desired, the pressure of the solution may be reduced as the leaching process nears completion.

Yet another advantage of the present invention is the ability to rapidly and effectively remove ceramic residue from the interior of investment castings. This is possible by high pressure impingement of solution onto the core to loosen and dissolve the ceramic material. Employment of a small diameter nozzle located at or near the core surface further facilitates thorough removal of the ceramic material by precisely directing the solution at the core.

In addition, the core surface can on occasion form a surface layer that seems to be impervious to chemical attack. The reason for the formation of this barrier is not fully understood, but is thought to be the result of either a local chemical or phase change condition within the core itself, and/or that the chemical reaction has leached away ingredients within the core, such as Zr, which aid in the leaching process. The aggressive high pressure stream of the present invention can break through this barrier. The high pressure stream is also very effective in enabling the leaching material to reach non line of sight areas of the core.

The present invention also has application in airfoil refurbishment. For example, debris, such as sand and dirt, often gets injested into airfoil cavities during engine operation. The process of the present invention may be employed to remove such debris and thereby clean the airfoil.

The invention is not limited to the particular embodiments shown and described herein. Various changes and modifications may be made without departing from the spirit or scope of the claimed invention. For example, although the invention has been described with respect to the removal of one core from an investment casting, the present invention also includes the use of a plurality of high pressure solution streams for removal of a plurality of cores from numerous investment castings. This embodiment would increase the efficiency of the removal process.

What is claimed is:

1. A method of removing a ceramic core from an investment casting comprising directing a stream of high pressure solution between about 5,000 psi (345 bar) and about 10,000 psi (690 bar) at the core to loosen and dissolve the core thereby creating a cavity.

2. The method of claim 1 wherein pressure is varied between about 5,000 psi (345 bar) and about 10,000 psi (690 bar).

3. The method of claim 1 further comprising the step of directing steam at the cavity for removal of ceramic residue.

4. The method of claim 1 further comprising the step of applying a negative pressure to the cavity for removal of ceramic residue.

5. The method of claim 1 wherein the solution is an alkali solution.

6. The method of claim 1 further comprising positioning the stream of high pressure solution below the core and pulsing the stream upward toward the core to loosen and dissolve the ceramic core such that loosened ceramic is removed from the casting by gravity between pulses, wherein between about 1 second and about 10 seconds elapse between each pulse.

7. The method of claim 6 wherein the solution flows through a pressure port including an exit nozzle having an inner diameter between about 20 mils (0.508 mm) and about 70 mils (1.78 mm), wherein the exit nozzle is located at the surface of the core.

8. The method of claim 6 wherein the solution flows through a pressure port including an exit nozzle having an inner diameter between about 20 mils (0.508 mm) and about 70 mils (1.78 mm), wherein the exit nozzle is protruded into the cavity to facilitate removal of ceramic material.

9. A method of refurbishing an investment casting comprising:

providing an investment casting having an internal cavity with debris material therein; and directing a stream of high pressure solution between about 5,000 psi (345 bar) and about 10,000 psi (690 bar) at the debris material to loosen and remove the material.

10. The method of claim 9 wherein the investment casting is a gas turbine engine airfoil.

11. The method of claim 9 further comprising pulsing the stream of high pressure solution at the debris material to loosen and remove the material.

* * * * *